US005625951A

United States Patent [19]

Hamlin

[11] Patent Number: 5,625,951

[45] Date of Patent: May 6, 1997

[54] COMBINATION HAND TOOL FOR CUTTING FLEXIBLE DUCT AND THE LIKE

[75] Inventor: Michael R. Hamlin, Gig Harbor, Wash.

[73] Assignee: Flexible Technologies, Inc., Abbeville, S.C.

[21] Appl. No.: 567,117

[22] Filed: Dec. 4, 1995

[51] Int. Cl.[6] ..... B26B 13/24

[52] U.S. Cl. ..... 30/146; 30/131

[58] Field of Search ..... 30/142, 131, 132, 30/330, 331, 146; 7/130, 133

[56] References Cited

U.S. PATENT DOCUMENTS

| | | | |
|---|---|---|---|
| 1,993,731 | 3/1935 | Behrman | 30/331 |
| 5,185,930 | 2/1993 | Hamlin | 30/131 |

*Primary Examiner*—Douglas D. Watts

*Attorney, Agent, or Firm*—Francis N. Carten

[57] ABSTRACT

A combination hand tool for cutting flexible duct and the like, which tool has both (i) a blade-holding mechanism which enables safe, quick and convenient replacement of a utility knife blade for cutting material requiring relatively low cutting pressure (e.g., the insulated portion of flexible duct) and (ii) a replaceable cutting tool having a cutting edge moveable against a cutting surface to enable the user to generate relatively high cutting force on a piece requiring such high cutting force (e.g., the metal or plastic wire component of flexible duct). In the preferred embodiment of the invention, the aforementioned blade-holding mechanism includes two similarly-shaped, overlying plates which are both pivotably moveable to enable separation of the plates and replacement of the utility knife blade positioned therebetween. Also, the aforementioned replaceable cutting tool is held in its operating position by a holding mechanism for releasably securing the cutting tool.

19 Claims, 3 Drawing Sheets

COMBINATION HAND TOOL FOR CUTTING FLEXIBLE DUCT AND THE LIKE

BACKGROUND OF THE INVENTION

Razor-type blades have long been used for cutting various materials. However, by themselves, such blades are difficult to manipulate and dangerous to handle. Accordingly, numerous types of handles have been proposed for mounting such blades. These handles provide greater control and ease of manipulation in cutting and provide a safer mechanism for gripping the blades. Nevertheless, considerable difficulty is still involved in installing the razor-type blades on the handles and in removing the blades from the handles. Furthermore, it is often desirable to combine a razor-type blade with other hand tools, such as pliers, wire cutters and the like. My prior U.S. Pat. No. 5,185,930 entitled FLEX-DUCT CUTTERS issued on Feb. 16, 1993 is an example of such a pliers-type hand tool. However, such hand tools are usually formed of cast or forged tool steel, which is extremely expensive and difficult to work. Consequently, the cost of such hand tools is relatively high. Also, pliers-type hand tools are usually designed to perform a specific function and are not convertible to perform other functions. For example, conventional pliers-type hand tools cannot be readily converted to perform cutting operations. Thus, none of the prior art hand tools have been entirely satisfactory for enabling the user to perform a combination of tasks, and to do so safely and conveniently.

SUMMARY OF THE INVENTION

The present invention is embodied in a combination hand tool for cutting flexible duct and the like, which tool has both (i) a blade-holding mechanism which enables safe, quick and convenient replacement of a utility knife blade for cutting material requiring relatively low cutting pressure (e.g., the insulated portion of flexible duct) and (ii) a replaceable cutting tool having a cutting edge moveable against a cutting surface to enable the user to generate relatively high cutting force on a piece requiring such high cutting force (e.g., the metal or plastic wire component of flexible duct). In the preferred embodiment of the invention, the aforementioned blade-holding mechanism includes two similarly-shaped, overlying plates which are both pivotably moveable to enable separation of the plates and replacement of the utility knife blade positioned therebetween. Also, the aforementioned replaceable cutting tool is held in its operating position by a holding mechanism for releasably securing the cutting tool.

The disadvantages of prior art hand tools are overcome with the present invention, a combination hand tool which is simple and inexpensive to produce, yet which enables the user to perform several functions and which enables the user to safely, conveniently and quickly mount and demount a utility knife blade or the like.

The present application discloses and claims an improvement upon an invention disclosed and claimed in co-pending U.S. patent application Ser. No. 08/174,251 entitled PLIER-TYPE HAND TOOL filed on Dec. 28, 1993 by Michael R. Hamlin, who has assigned said application to Flexible Technologies, Inc., the assignee of the present application.

An object of the present invention is to provide an improved combination hand tool of the type shown in said co-pending patent application.

An additional object of the present invention is to provide an improved combination hand tool which is simple and inexpensive to produce.

A further object of the present invention is to provide an improved combination hand tool which enables the user to perform multiple functions.

Another object of the present invention is to provide an improved combination hand tool which is capable of enabling the user to safely, quickly and conveniently mount and demount a razor-type utility knife blade.

These and other objects and features of the present invention will be apparent from the following description.

DESCRIPTION OF THE DRAWINGS

The written description of the present invention will be more fully understood when read with reference to the accompanying drawings, of which.

DETAILED DESCRIPTION OF THE PREFERRED EMBODIMENT

Figure 1:
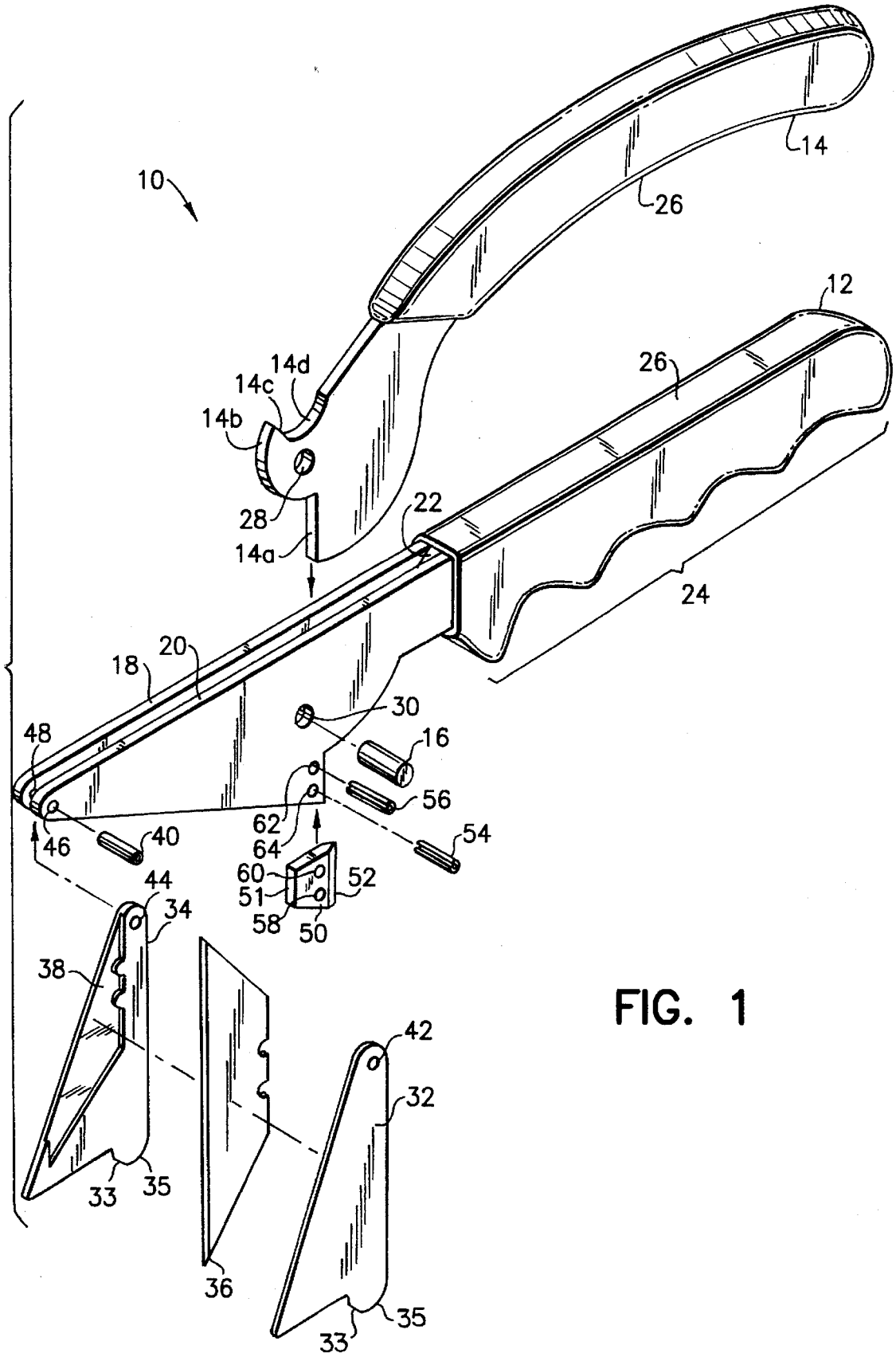
FIG. 1 is an exploded perspective view of the preferred embodiment of applicant's combination hand tool, showing the various components of the tool and their relationships to one another.
Figure 2:
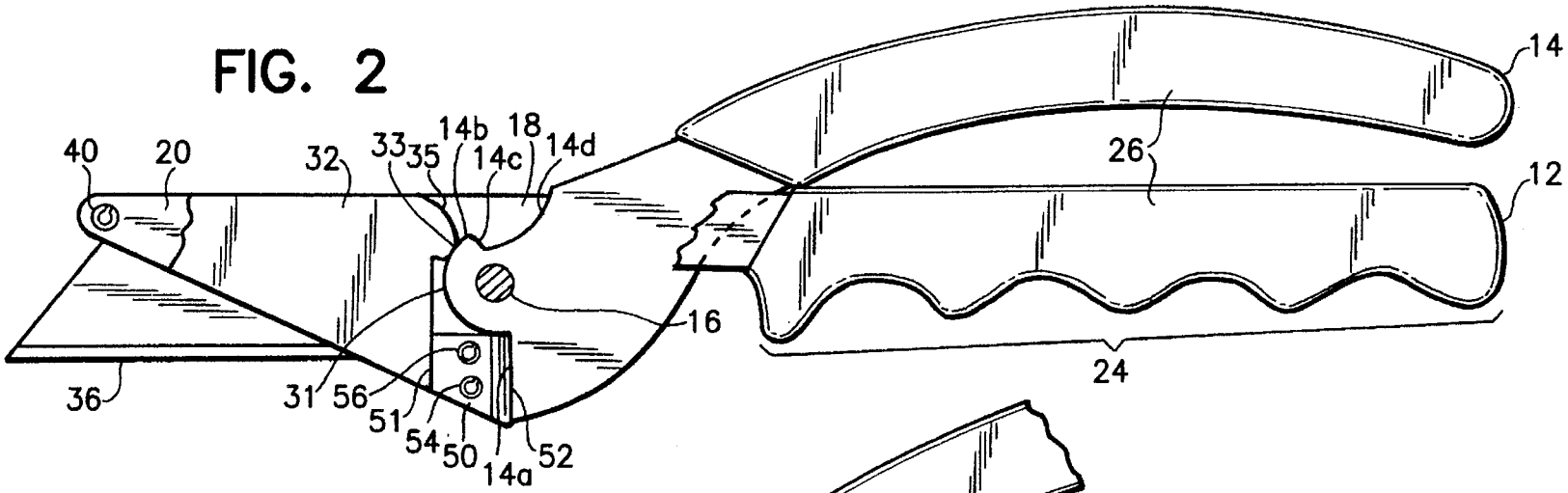
FIG. 2 is a first partially broken-away side view of the combination hand tool of FIG. 1, showing the handles closed to form a grip for wielding the blade.

Referring now specifically to FIG. 1, the combination hand tool 10 has a first member 12 and a second member 14 which are pivotably connected by suitable means such as a pin 16 or a roll pin. The first member 12 is formed of a pair of side plates 18 and 20 which are joined by a spacer member 22 to allow the second member 14 to have a clearance fit between the two side plates 18 and 20. The side plates 18 and 20 and spacer member 22 may be formed of sheet metal and may be secured together by welding, adhesive or any other suitable means. Optionally, a horizontal pressure bar can be spot-welded to the bottom edges of the side plates 18 and 20 and spacer member 22 to provide a wider area to which hand pressure can be applied. The pin 16 passes through three similarly-sized apertures which are in registration with one another, aperture 28 being formed in the second member 14, aperture 30 in the side plate 20, and an aperture (not shown) in side plate 18 positioned opposite aperture 28. The pin 16 may be secured to one or both of the side plates 18, 20 by means such as welding, adhesive or other suitable means. Preferably, the first member 12 is formed with undulations 24 to provide a comfortable hand grip. The undulations 24 can also be incorporated into the aforementioned optional horizontal pressure bar. Both the grip portion of the first member 12 formed with the undulations 24 and the overlying grip portion of the second member 14 are preferably covered with layers of plastic 26 to provide smooth, non-slip gripping surfaces. Thus, a comfortable and efficient hand grip is formed when the first member 12 and the second member 14 are rotated to bring the two grip portions of first and second members 12 and 14 into closest proximity. The second member 14 has a series of surfaces 14*a*, 14*b*, 14*c*, and 14*d* formed around the mounting hole 28. The surface 14*a* is a cutting surface, preferably formed by brazing on a carbide insert to form an integral component of second member 14. The surface 14*b* is a convexly-curved arcuate edge of the second member 14, and is designed to engage the small, concave, free corner edge 33 of the blade-holding subassembly to prevent that subassembly from rotating in a clockwise direction, as shown in FIG. 2. The surface 14*c* engages the small, concave, free corner edge 33 during the repositioning of the blade-holding subassembly after replacing the utility knife blade 36. The surface 14*d* is a partially concavely-curved arcuate edge of the second member 14, and is designed to engage the convexly-curved free corner edge 35 of the blade-holding subassembly when releasing that subassembly, as described hereunder. Optionally, a horizontal pressure bar can be spot-welded to the top edge of second member 14 before the formation of the plastic coating 26 to provide a wider area to which hand pressure can be applied.

A blade-holding subassembly is formed by opposed plates 32 and 34 to secure the utility knife blade 36. Plate 32 is flat on both of its parallel sides. Plate 34 is contoured identically to plate 32, except for a recess 38 formed for receiving the blade 36. Plates 32 and 34 are pivotably connected to one another and to the first member 12 by suitable means such as a rivet 40 or a screw-and-nut combination passing through four apertures in registration with one another, viz., apertures 42 and 44 in plates 32 and 34, respectively, and opposed apertures 46 and 48 at the tips of side plates 20 and 18, respectively. When a blade 36 is positioned in the recess 38 of plate 34 as shown in FIG. 5, and plates 32 and 34 are rotated to overly one another, the blade-holding subassembly thus formed is swung toward the first member 12 to have the subassembly's convexly-contoured free corner surface 35 engage the concavely-contoured surface 14*d* of the second member 14, and be moved through the positions shown in FIGS. 4, 3 and 2 (in that sequence) by closing the grip portions of first and second members 12 and 14 while rotating the blade-holding subassembly counter-clockwise. The subassembly is finally retained in its operational position by (1) the convexly-curved arcuate edge 14*b* of the second member 14 abutting the small, concave free corner edge 33 of the blade-holding subassembly and (2) the flat edge 37 of the blade-holding subassembly abutting the flat, vertical edge 51 of cutting tool 50, thereby to secure the blade-holding subassembly and the blade 36 retained therein in position for use to cut insulated duct and the like, as shown in FIG. 2. By grasping the hand grip formed by the plastic-coated portions of first and second members 12 and 14, the user can easily, safely and comfortably manipulate blade 36 to perform any desired cutting operation requiring relatively low cutting pressure.

Figure 3:
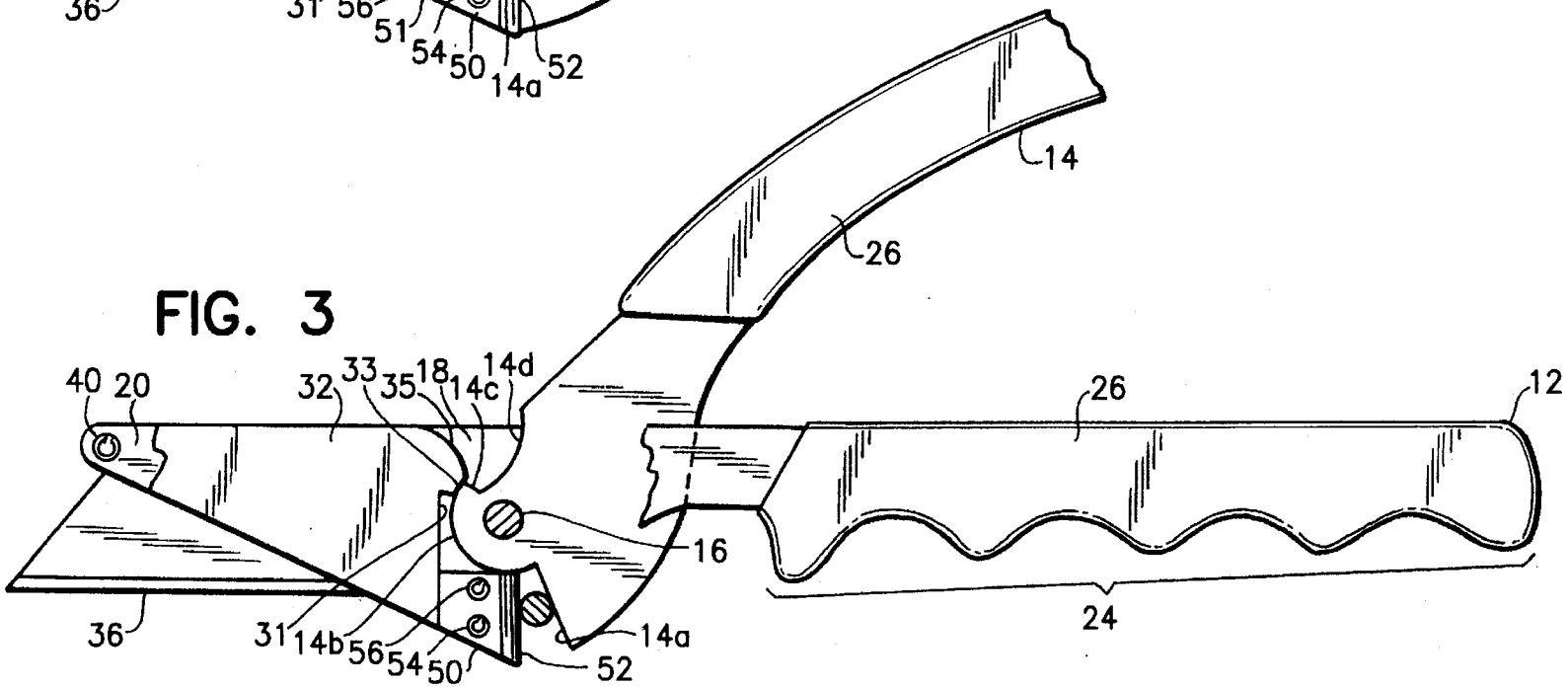
FIG. 3 is a second partially broken-away side view of the combination hand tool of FIG. 1, showing the handles partially opened to enable the tool to be used as a wire cutter while securely holding the blade-holding subassembly in its operational position.
Figure 4:
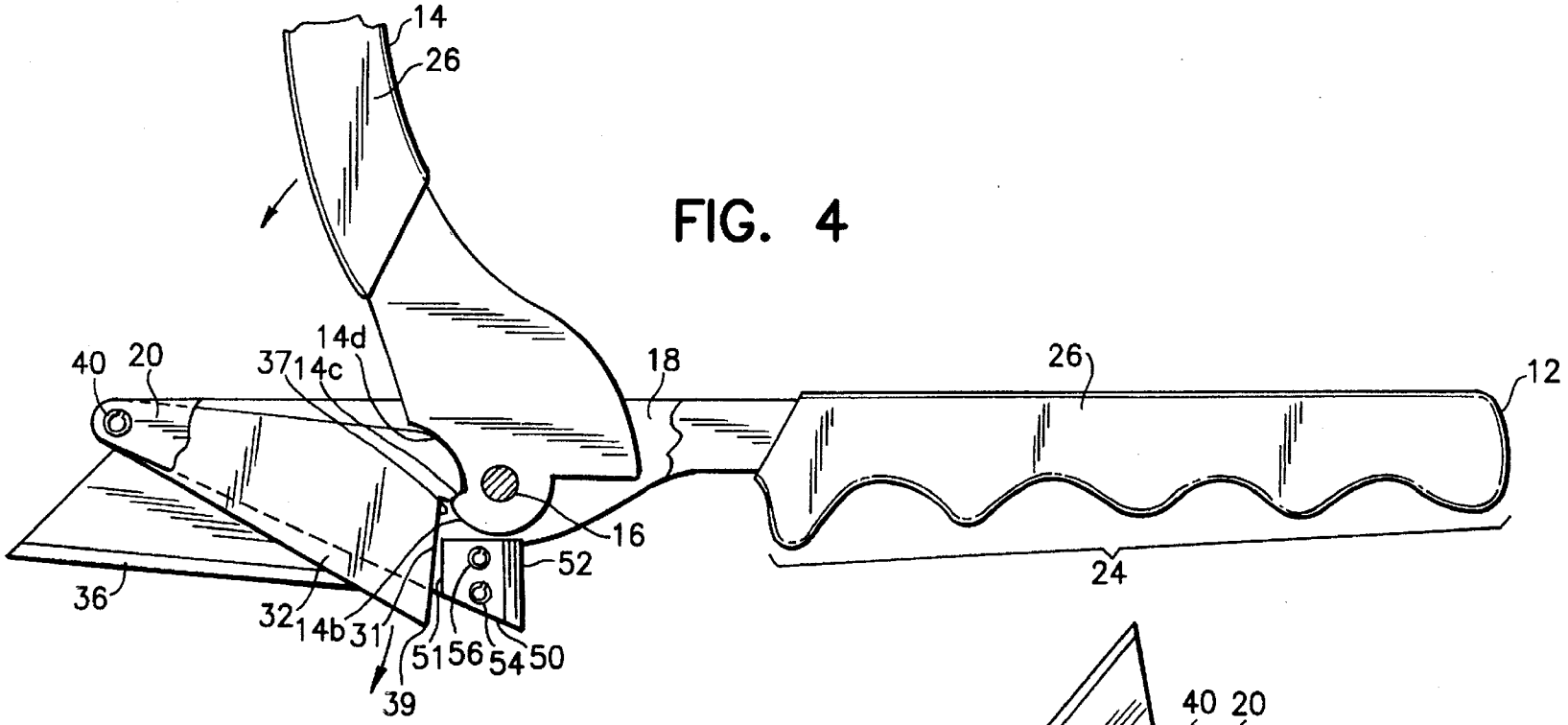
FIG. 4 is a third partially broken-away side view of the combination hand tool of FIG. 1, showing the handles fully opened to release the blade-holding subassembly and thereby enable the replacement of the blade.
Figure 5:
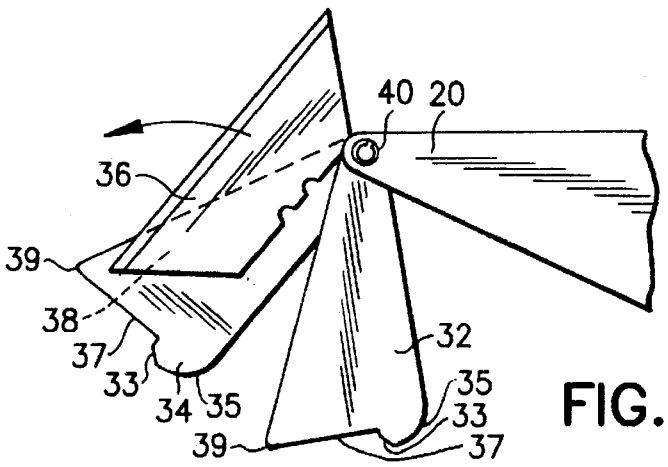
FIG. 5 is a detail side view of the blade-holding subassembly shown in FIGS. 1–4, swung away from its operational position and fanned open to completely expose the blade.

When the user desires to change the utility knife blade 36 after a period of use, he simply raises the handle portion of second member 14 through the several stages shown in FIGS. 2, 3 and 4 (in that sequence) to the open-handle position to disengage the second member 14 from the blade-holding subassembly formed by plates 32 and 34. By moving the second member slightly further in the direction of the arrow shown in FIG. 4, the blade-holding subassembly formed by plates 32 and 34 is cammed partially out from between the side plates 18 and 20, thereby allowing the user to either grasp the sharp free corner 39 or to shake the blade-holding subassembly to completely expose it, and then fan it open and remove blade 36 from the recess 38 for disposal, as shown in FIG. 5. A new blade may then be placed in recess 38, the plates 32 and 34 brought together again to overly one another, and the blade-mounting subassembly swung back toward first member 12 and on to its operational position as described above, and the tool 10 is ready for use again.

A cutting tool 50 formed with cutting edge 52 is preferably formed of tool steel and is secured in place between side plates 18 and 20 by any suitable means such as set screws or roll pins 54 and 56 which, respectively, pass through (i) circular hole 62 in side plate 20, circular hole 60 in cutting tool 50, and a circular hole in side plate 18 (not shown), each hole aligned with the others and of similar size, and (ii) circular hole 64 in side plate 20, circular hole 58 in cutting tool 50, and a circular hole in side plate 18 (not shown), each hole aligned with the others and of similar size. When the first and second members 12 and 14 are in the closed position, as seen in FIG. 2, the cutting edge 52 will also be in a closed position against the cutting surface 14*a* of the second member 12 to prevent inadvertent contact with cutting edge 52. Thus, the only exposed cutting surface will be that of the blade 36, and the combination tool 10 can be handled with safety.

When the combination tool 10 is to be used to cut wire or any other workpiece requiring relatively high cutting force, the cutting edge 52 and the cutting surface 14*a* are separated by opening the grip portions of the first and second members 12 and 14, and positioning the wire between the cutting edge 52 and the cutting surface 14*a*, as shown in FIG. 3. As the cutting edge 52 and the cutting surface 14*a* are separated, the blade-holding subassembly continues to be retained in its operational position by the convexly-curved arcuate edge 14*b* of the second member 14 abutting the small, concave free corner edge 33 of the blade-holding subassembly. The user can now introduce the wire between the cutting edge 52 and the cutting surface 14*a*, and apply high cutting force to the wire by grasping the grip portions of the first and second members 12 and 14 and squeezing them toward one another, thereby moving the cutting edge 52 and the cutting surface 14*a* toward one another.

Certain modifications and variations of the disclosed embodiment of the present invention will be apparent to those skilled in the art. It should be understood that the disclosed embodiment is intended to be illustrative only, and not in any way restrictive of the scope of the invention as defined by the claims set forth hereunder.

I claim:

1. A combination hand tool comprising:

(a) first and second pivotably-attached members, each having a grip portion, said grip portions forming a hand grip when said first and second pivotably-attached members are rotated to bring said grip portions into proximity;

(b) blade-holding means pivotably attached to said first member and releasably retained by engagement with said second member, and operative to enable quick replacement of a utility knife blade retained therein; and (c) cutting means comprising (i) a cutting tool having a cutting edge removably mounted on said first member and (ii) an opposed cutting surface on said second member, said cutting edge and said opposed cutting surface being movable toward and away from one another by relative rotation of said first and second members, thereby enabling the user to generate relatively high cutting force.

2. The combination hand tool according to claim 1, wherein said first member comprises:

(a) a first side plate having two flat, parallel surfaces;

(b) a second side plate having two flat, parallel surfaces and substantially identical to said first side plate, said first and second side plates being positioned side-by-side, parallel and spaced away from one another; and (c) means for mechanically connecting said first and second side plates.

3. The combination hand tool according to claim 2, wherein said blade-holding means comprises:

(a) a first plate having two flat, parallel surfaces and a continuous edge between said parallel surfaces, and (b) a second plate having one flat, parallel surface and a second flat, parallel surface with a recess therein for receiving said utility knife blade, and a continuous edge between said surfaces, said plates being similar in profile and pivotably connected to one another and to the end of the first member remote from said grip portion.

4. The combination hand tool according to claim 3, wherein said first and second plates of said blade-holding means are positionable to overly one another and thereby retain said utility knife blade therebetween, and to be secured in said overlying position between the first and second side plates of said first member by engagement with said second member.

5. The combination hand tool according to claim 4, wherein:

(a) said first and second plates of said blade-holding means, when overlying, form a concave free corner edge; and (b) said second member comprises a convexly-curved arcuate edge which engages said concave free corner edge so as to retain said blade-holding means between the first and second side plates of said first member.

6. The combination hand tool according to claim 5, wherein said concave free corner edge of said blade-holding means engages said convexly-curved arcuate edge of said second member.

7. The combination hand tool according to claim 6, wherein said convexly-curved arcuate edge of said second member engages said concave free corner edge of said blade-holding means through a predetermined angle of rotation of said first and second pivotably-attached members.

8. The combination hand tool according to claim 4, wherein:

(a) said first and second plates of said blade-holding means, when overlying, form a convexly-contoured free corner edge; and (b) said second member comprises a concavely-curved arcuate edge which engages said convexly-contoured free corner edge when releasing said blade-holding means from between the first and second side plates of said first member.

9. The combination hand tool according to claim 1, wherein said grip portion of said first member is formed with undulations to facilitate gripping.

10. The combination hand tool according to claim 1, wherein said grip portions of said first and second members are coated with non-slip plastic.

11. In a combination hand tool having first and second pivotably-attached members each having a grip portion, said grip portions forming a hand grip when said first and second members are rotated to bring said grip portions into proximity, and means for holding a utility knife blade for cutting material requiring relatively low cutting pressure, the improvement comprising:

(a) blade-holding means formed by (i) a first plate having two flat, parallel surfaces and a continuous edge between said parallel surfaces, and (ii) a second plate having one flat, parallel surface and a second flat, parallel surface with a recess therein for receiving the utility knife blade, and a continuous edge between said surfaces, said plates being similar in profile and pivotably connected to one another and to the end of the first member remote from said grip portion; and (b) cutting means comprising first and second opposed cutting members to enable the user to generate relatively high cutting force.

12. The improvement according to claim 11, wherein said first and second opposed cutting members comprise, respectively, a replaceable cutting member with a sharp edge mounted on said first member, and a cutting surface mounted on said second member, said cutting edge and said opposed cutting surface being movable toward and away from one another by relative rotation of said first and second members, thereby enabling the user to generate relatively high cutting force.

13. The improvement according to claim 11, wherein said first and second plates of said blade-holding means are positionable to overly one another and thereby retain said utility knife blade therebetween, and to be secured in said over-lying position between the first and second side plates of said first member by engagement with said second member.

14. The improvement according to claim 11, wherein said:

(a) said first and second plates of said blade-holding means, when overlying, form a concave free corner edge; and (b) said second member comprises a convexly-curved arcuate edge which engages said concave free corner edge so as to retain said blade-holding means between the first and second side plates of said first member.

15. The improvement according to claim 14, wherein said concave free corner edge of said blade-holding means engages said convexly-curved arcuate edge of said second member.

16. The improvement according to claim 14, wherein said convexly-curved arcuate edge of said second member engages said concave free corner edge of said blade-holding means through a predetermined angle of rotation of said first and second pivotably-attached members.

17. The improvement according to claim 11, wherein:

(a) said first and second plates of said blade-holding means, when overlying, form a convexly-contoured free corner edge; and (b) said second member comprises a concavely-curved arcuate edge which engages said convexly-contoured free corner edge when releasing said blade-holding means from between the first and second side plates of said first member.

18. The improvement according to claim 11, wherein said grip portion of said first member is formed with undulations to facilitate gripping.

19. The improvement according to claim 11, wherein said grip portions of said first and second members are coated with non-slip plastic.

* * * * *